US007316128B1

(12) United States Patent
Dargusch

(10) Patent No.: US 7,316,128 B1
(45) Date of Patent: Jan. 8, 2008

(54) JEWELRY ITEM FOR HOUSING A CATHETER

(76) Inventor: Lindsey Dargusch, 2586 Bexley Park Rd., Columbus, OH (US) 43209

( * ) Notice: Subject to any disclaimer, the term of this patent is extended or adjusted under 35 U.S.C. 154(b) by 20 days.

(21) Appl. No.: 10/990,108

(22) Filed: Nov. 15, 2004

(51) Int. Cl.
*A44C 15/00* (2006.01)

(52) U.S. Cl. ..... 63/1.14

(58) Field of Classification Search ..... 206/304.1, 206/438, 69, 457, 37, 527, 570, 571, 38; 63/1.14, 18, 19, 33; 224/219, 201
See application file for complete search history.

(56) References Cited

U.S. PATENT DOCUMENTS 4,116,338 A * 9/1978 Weichselbaum ..... 206/438
4,502,298 A * 3/1985 Benton ..... 63/1.14
4,662,873 A 5/1987 Lash ..... 604/179
4,733,807 A * 3/1988 Porter et al. ..... 224/604
4,768,688 A * 9/1988 Harrigan ..... 224/148.2
5,217,143 A * 6/1993 Aitken ..... 222/78
5,562,622 A 10/1996 Tihon ..... 604/105
5,622,293 A * 4/1997 LeFevre ..... 224/148.2
5,643,216 A 7/1997 White ..... 604/174
5,651,274 A * 7/1997 Taylor ..... 63/18
6,053,313 A * 4/2000 Farrell et al. ..... 206/364
6,065,597 A 5/2000 Pettersson ..... 206/364
6,126,639 A 10/2000 Sutherland ..... 604/179
6,171,230 B1 1/2001 Hakky ..... 600/29
6,579,268 B1 6/2003 Loining ..... 604/174

* cited by examiner

*Primary Examiner*—Jack W. Lavinder
(74) *Attorney, Agent, or Firm*—Standley Law Group LLP

(57) ABSTRACT

An article of jewelry provides an internal compartment for storing and concealing a catheter. When the catheter is needed, the user releases the fastening device which keeps the catheter inside the article of jewelry. After releasing the fasteners, the user extracts the catheter and uses it accordingly. Once the user finishes, the catheter is cleaned. The user then places the catheter within the article of jewelry and secures the catheter using the fasteners. Thus, the article of jewelry cleverly disguises the catheter from public view.

13 Claims, 5 Drawing Sheets

JEWELRY ITEM FOR HOUSING A CATHETER

FIELD OF THE INVENTION

This invention relates generally to an article of jewelry and more specifically, to an article of hollowed jewelry for storage and concealment of a catheter.

BACKGROUND OF THE INVENTION

Many people require the use of a catheter for various medical reasons. Catheters may be needed to facilitate urine flow because of medical conditions, including but not limited to neurological disorders, multiple system atrophy, spina bifida, and cerebro-vascular disease. Catheters have provided a way for people affected by these medical conditions to induce urine flow from their bladder. Catheters are well known. Due to the importance of expelling urine from the bladder at multiple times each day, a catheter is a daily essential to users that require catheters for urination.

Catheters are generally composed of flexible tubes. In most embodiments, catheters are comprised of two ports. The larger port drains the urine. The other port holds the catheter in place in the urinary tract.

Most catheters are of a length and cross section diameter that enable them to be carried in purses or pockets. However, carrying items such as a purse restricts the user from their daily routines. Moreover, some articles of clothing lack pockets to contain the catheters.

As a result, a need exists to provide an improved way of transporting a catheter that overcomes the above mentioned problems. A need exists for containing a catheter while allowing for a user to perform their daily routines without having to carry a purse or restricting the style of clothes they wear.

SUMMARY OF THE INVENTION

In accordance with one preferred embodiment of the present invention, an article of jewelry includes a receptacle therein for housing a catheter.

The article of jewelry preferably totally conceals the catheter and is constructed to allow ready access and ease of removability when the user needs to use the catheter.

In accordance with the present invention, the catheter may be extracted from the article of jewelry, used, cleaned, and inserted back into the article of jewelry.

In another embodiment of the present invention, the article of jewelry may be adapted to house accessory items such as lubrication for the catheter.

In yet another embodiment of the present invention, two catheters are housed within an article of jewelry.

In a preferred embodiment, the article of jewelry may be a bracelet, a watch, or a necklace.

In accordance with one embodiment of the present invention, an article of jewelry for housing and concealing a catheter is described. The article of jewelry stores the catheter in a hollowed area within the jewelry. An opening device to the hollowed area allows insertion of and later removal of the catheter. A fastening device may be employed to secure the opening device to prevent the catheter from sliding out. When the fastening device is opened, the catheter may be extracted from the opening device. After usage, the catheter is cleaned and then inserted back into the hollowed area through the opening device and secured by the fastening device.

The foregoing and other objects, features, and advantages of the invention will be apparent from the following, more particular, description of the preferred embodiments of the invention, as illustrated in the accompanying drawing.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiments when read in conjunction with the accompanying drawings, wherein like reference numerals and symbols represent like elements.

DETAILED DESCRIPTION

Figure 1:
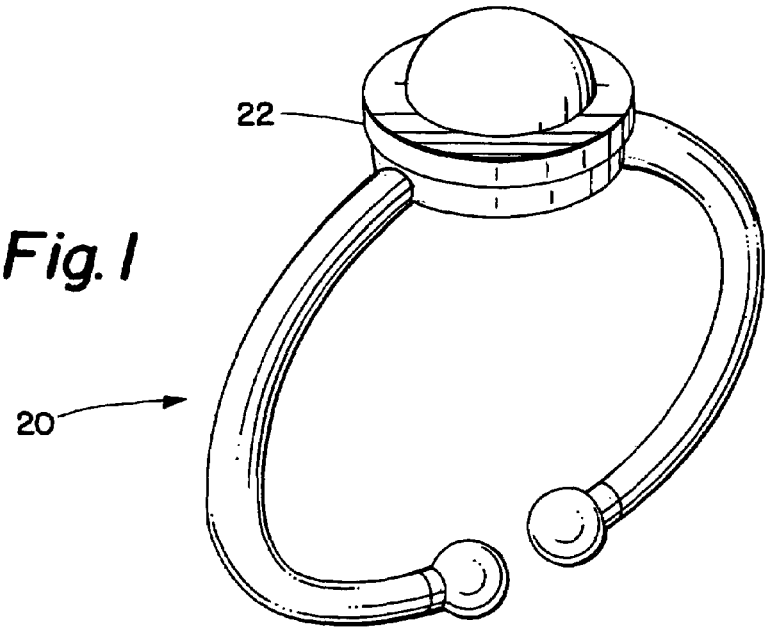
FIG. 1 is a perspective view of one embodiment of a gemstone bracelet adapted for storing and concealing a catheter.

Referring to the Figures, an article of jewelry 20 with an inserted catheter 24 will be described. When the catheter 24 is needed, the user extracts the catheter 24 from the article of jewelry 20. After using the catheter 24, the user simply washes the catheter 24 and places it back into the article of jewelry 20. As a result of its easy use, the article of jewelry 20 containing the inserted catheter 24 will allow for a user to perform their daily routines unrestricted by what they carry or the clothes they wear.

A catheter 24 for inserting into an article of jewelry 20 is now described. A catheter 24 comes in a variety of sizes and forms. In length, catheters 24 range from three to sixteen inches. The diameter of the catheter 24 varies from four to seven millimeters. Moreover, some catheters 24 contain flat heads and others have circular heads.

Typically, catheters 24 comprise a set of ports placed in the bladder to drain urine. In most embodiments, the catheter 24 contains two ports. The holder port maintains the catheter 24 in place. The drainer port removes the urine from the malfunctioning bladder. As a result, the catheter 24 maintains its position within the malfunctioning bladder while draining urine.

Catheters 24 generally consist of a flexible material that is compatible with intimate bodily use. Catheters 24 may be made of a poly(tetrafluoroethylene) such as that available commercially under the trademark TEFLON, flexible plastic, latex, or silicone rubber, depending on the user's preferences. By using the flexible material, the catheter 24 conforms to the urinary tract while inserted into the malfunctioning bladder. Additionally, the flexible material conforms to the article of jewelry 20 while not in use.

In order to lessen the restrictions on carrying the previously described catheters 24, the novel interior holder 28 of an article of jewelry 20 stores and conceals the catheter 24. Now referring to FIGS. 1 through 3, the interior holder 28 of a gemstone bracelet 20 is described. The interior holder 28 comprises a hollowed area 26 for storing the catheter 24. The length and width of the hollowed area 26 depends on the length and width of the catheter 24. Consequently, the longer and wider the catheter 24, the longer and wider the hollowed 26 area will be.

Figure 3:
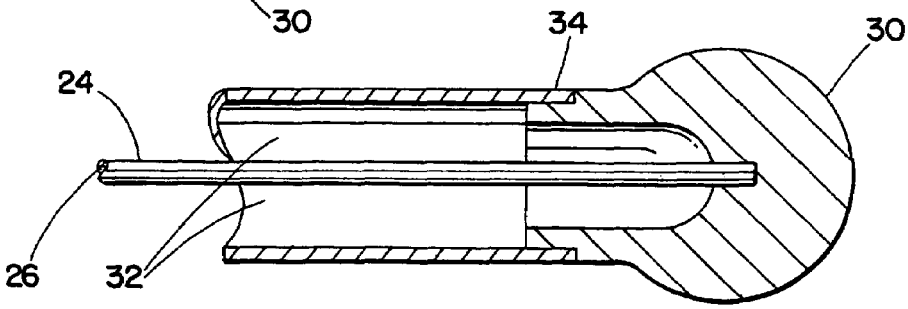
FIG. 3 is a sectional view taken along line 3-3 of FIG. 2.

The hollowed area 26 also includes special features where the catheter 24 is prevented from falling out and shifting within the article of jewelry 20. In FIG. 3, the hollowed area 26 is coupled by a material with a high coefficient of friction 32. As a result of the material 32, the catheter 24 is prevented from falling out and shifting inside the hollowed area 26. In another embodiment, the hollowed area 26 may also contain rivets which may be used to prevent the catheter 24 from falling out and shifting inside the hollowed area 26.

In still yet another embodiment, the hollowed area 26 is also coupled to guides. Similar to the material with a high coefficient of friction 32 and the rivets, the guides prevent the catheter 24 from falling out and shifting inside the hollowed area 26. However, the guides also create the easy insertion of the catheter 24 into the hollowed area 26.

Figure 2:
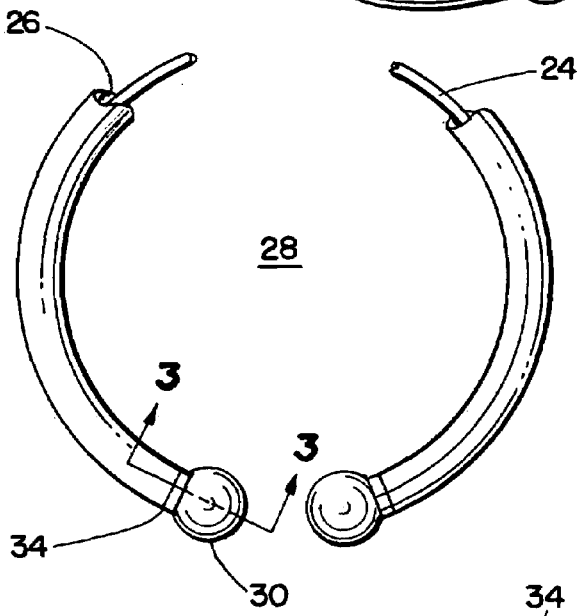
FIG. 2 is a partial cut-away view of the bracelet of FIG. 1, showing a catheter therein.

Additional to the hollowed area 26, the novel interior holder 28 comprises an opening device 34 for accessing the hollowed area 26 and a fastening device 30 for securing the opening device 34 as shown in FIGS. 2 and 3. The opening device 34 of the gemstone bracelet 20 contains a single opening 34 on an end section of the gemstone bracelet 20. The fastening device 30 includes a screw-like device 30. When the user goes to the restroom, the user unscrews the fastening device 30 from the single opening 34 and removes the catheter 24 along with the fastening device 30. The user then extracts the catheter 24 from the ball-shaped portion fastening device 30. When the user is finished with the catheter 24, the user inserts the catheter 24 back into the ball-shaped portion fastening device 30 and screws the fastening device 30 back onto the opening device 34, thus securing the catheter 24 from falling out.

In addition to a single opening on an end section 34, the gemstone bracelet 20 may also contain a set of openings at both end sections 34 of the gemstone bracelet 20. In this embodiment, the gemstone bracelet 20 allows for the easy retrieval of a catheter 24 stuck within the hollowed area 26.

Now referring to FIGS. 4 through 7, the interior holder 28 of an ID bracelet 20 is described. The interior holder 28 of the ID bracelet 20 is similar to the gemstone bracelet 20, which stores and conceals a catheter 24. However, there are several different features of this embodiment which are not present in the gemstone bracelet 20. For instance, the opening device 34 includes a horizontal planed section 34. The horizontal planed section 34 opens and closes through different fastening devices 30. On one width side of the horizontal planed section 34, pivoting hinges 30 couple the horizontal planed section 34 to a body portion of the ID bracelet 20. By using hinges 30, a freely pivoting horizontal planed section 34 is created. In addition, a set of fasteners 30 are coupled to the opposite side of the permanently fixed hinges 30 to secure the freely pivoting horizontal planed section 34. As a result, the pivoting hinges 30 and fasteners 30 allow the user to secure the catheter 24 within the hollowed area 26.

In another embodiment, the freely pivoting horizontal planed section 34 is removed. In lieu of the pivoting hinges 30, a plurality of fasteners 30 couples the horizontal planed section 34 to the body of the article of jewelry 20. Thus, the user may completely remove the horizontal planed section 34 when accessing a catheter 24.

In another difference, the ID bracelet 20 may store two catheters 24 in relation to the gemstone bracelet's one 20. When opened, each side of the bracelet 20 comprises a hollowed area 26 for storing catheters 24. The ID bracelet 20 carries a pair of regular sized catheter 24 by extending its length through a U-shaped hollowed area 26. Thereby, the ID bracelet 20 may contain two full length catheters 24.

In an embodiment not depicted, the lubrication holder 22, which will be described later, may be curtailed in order to store an elongated catheter 24. By drilling two holes in the lubrication holder 22, an elongated catheter 24 may be placed into the ID bracelet 20. As a result, the ID bracelet 20 would contain only one catheter 24, but it would be much longer.

Similar to the bracelets 20 presented above, the article of jewelry 20 with an inserted catheter 24 also pertains to necklaces 20 as shown in FIGS. 8 through 12. The interior holder 28 contains the same hollowed area 26 as the bracelets 20, but the necklace 20 differs in the opening device 34 and the fastening device 30. When the user goes to the restroom, the user pulls, instead of unscrewing or lifting, the fastening device 30 from the single opening 34. After pulling the fastening device 30 from the opening device 34, the user removes the catheter 24 and fastening device 9. The user uncouples the catheter 24 from the ball-shaped portion fastening device 30. When the user is finished with the catheter 24, the user inserts the catheter 24 back into the ball-shaped portion fastening device 30 and force-fits the fastening device 30 back into the single opening 34, thus securing the catheter 24 from falling out.

In addition to a single opening on an end section 34, the necklace 20 may also contain a set of openings at both end sections 34 of the article of jewelry 20. In these embodiments, the necklace 20 allows for the retrieval of a catheter 24 stuck within the hollowed area 26.

Figure 13:
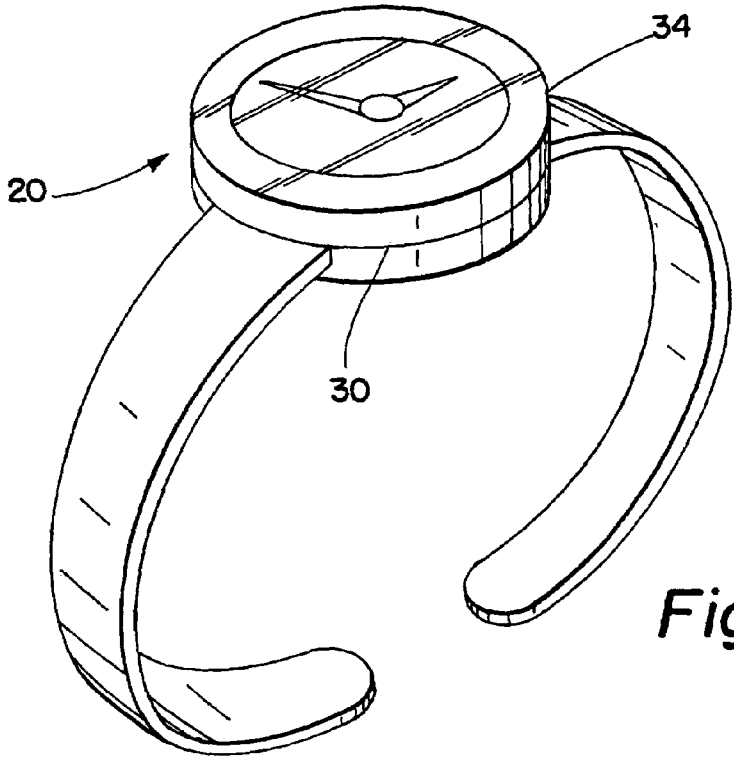
FIG. 13 is a perspective view of another embodiment of the present invention showing a watch adapted for storing and concealing a catheter.
Figure 14:
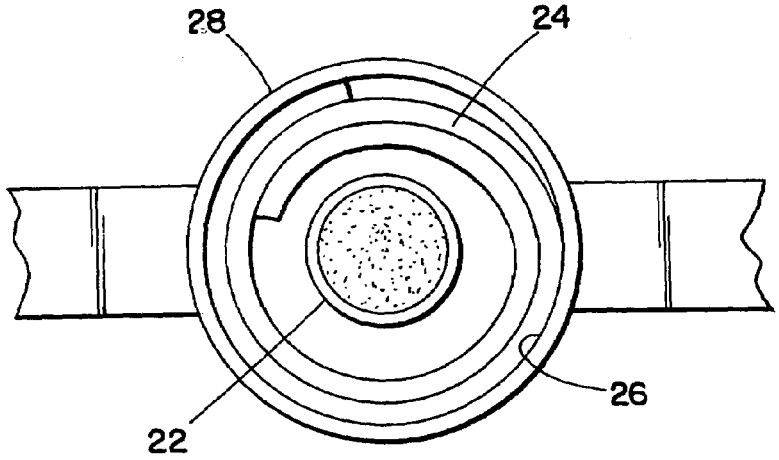
FIG. 14 is an interior plan view of the watch showing a coiled catheter in a hollowed area under the watch face.

Now referring to FIGS. 13 and 14, the interior holder 28 of a watch 20 with an inserted catheter 24 is described. Accordingly, the watch 20 stores the catheter 24 in two ways through differently shaped hollowed areas 26. First, as shown in FIG. 14, the catheter 24 is coiled within a circular shaped hollowed area 26. The opening device 34 includes a watch top 34 where the user may tell the corresponding time as shown in FIG. 13. The fastening device 30 connects the watch top 34 to the body of the article of jewelry 20.

Second, a watch 20 stores the catheter 24 through a hollowed area 26 of a wristband of the watch 20. The wristband allows the user to insert the catheter 24 into an opening on an end section 34 of the wristband of the watch 20. The fastening device 30 secures the catheter 24 from falling out of the opening device 34.

In another embodiment of the second hollowed area 26 of the wristband of the watch 20, the wristband contains a set of openings at both end sections 34. In this embodiment, the wristband of the watch 20 allows for the easy retrieval of a catheter 24 stuck within the hollowed area 26. Additionally, the opening at both end sections 34 allow for an elongated catheter 24 to be inserted into the article of jewelry 20. The elongated catheter 24 can be inserted into the article of jewelry 20 by first pushing the catheter 24 through one opening 34 and out the other opening 34. Then, the catheter 24 can once again be inserted through the first opening 34. The user may repeat this as many times as they wish. However, the amount of times the user may do this procedure is limited by the hollowed area 26.

Figure 15:
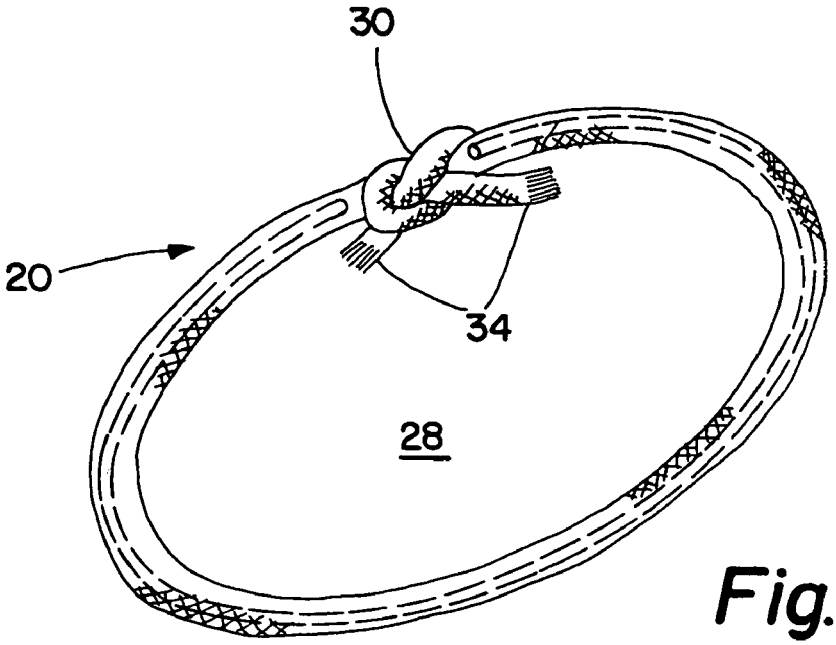
FIG. 15 is a perspective view of another embodiment of the present invention showing a cloth sleeve adapted to be worn as a bracelet for storing and concealing a catheter.
Figure 16:
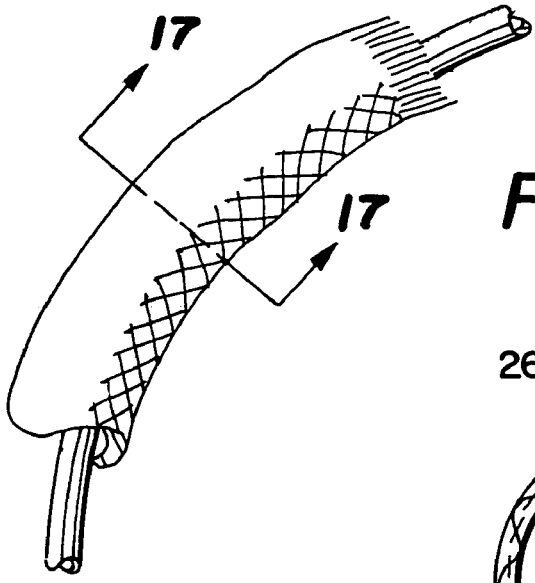
FIG. 16 is a partial cut-away view of the cloth sleeve of FIG. 15 showing the catheter within the cloth sleeve.
Figure 17:
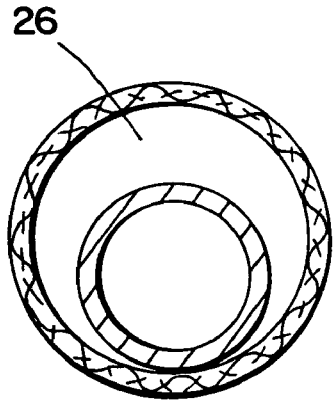
FIG. 17 is a cross-section view of the cloth sleeve of FIG. 15 with an inserted catheter.

In the final embodiment shown in FIGS. 15 through 17, the article of jewelry 20 stores and conceals the catheter 24 in a cloth sleeve 20 that ties around the wrist. Similar to the previous embodiments, the cloth sleeve 20 comprises an interior holder 28 which includes a hollowed area 26 for the catheter 24, an opening device 34 for inserting and extracting a catheter 24 from the hollowed area 26, and a fastening device 30 which prevents the catheter 24 from falling out of the opening device 34. The cloth sleeve 20, however, is differentiated by a rolling feature. Accordingly, the user may roll down the cloth sleeve 20 surrounding the catheter 24 for easy extraction of the catheter 24.

In the previously depicted embodiments, fastening devices 30 secured the opening device 34. The fastening devices 30 include any means or material which may secure the catheter 24 from falling out. For instance, a clip, Velcro, or metal latch may secure the catheter 24 from falling out of the opening device 34.

Figure 4:
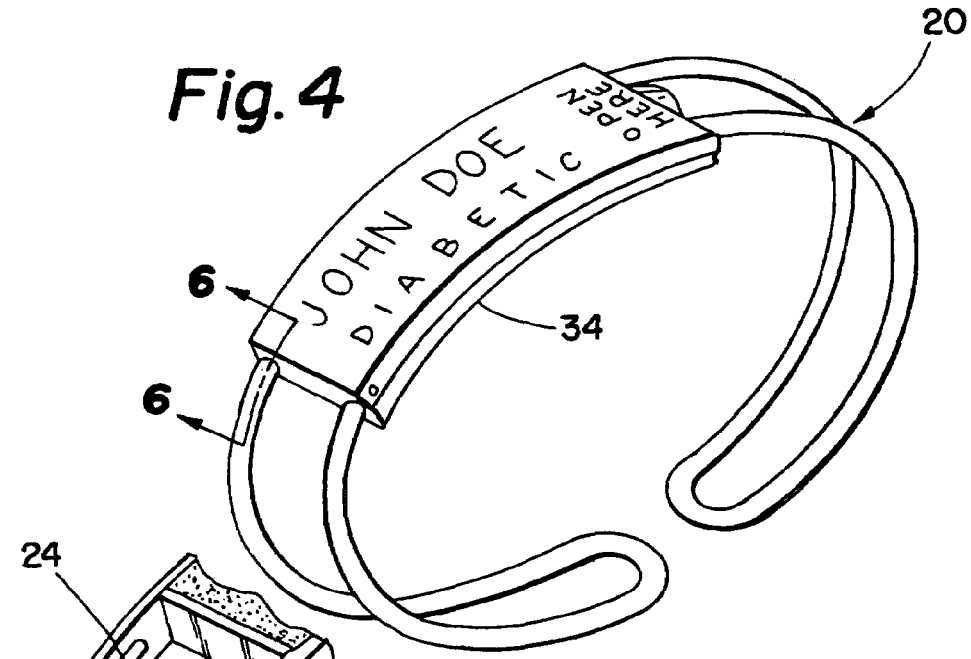
FIG. 4 is a perspective view of another embodiment of the present invention showing an ID bracelet for storing and concealing two catheters.
Figure 5:
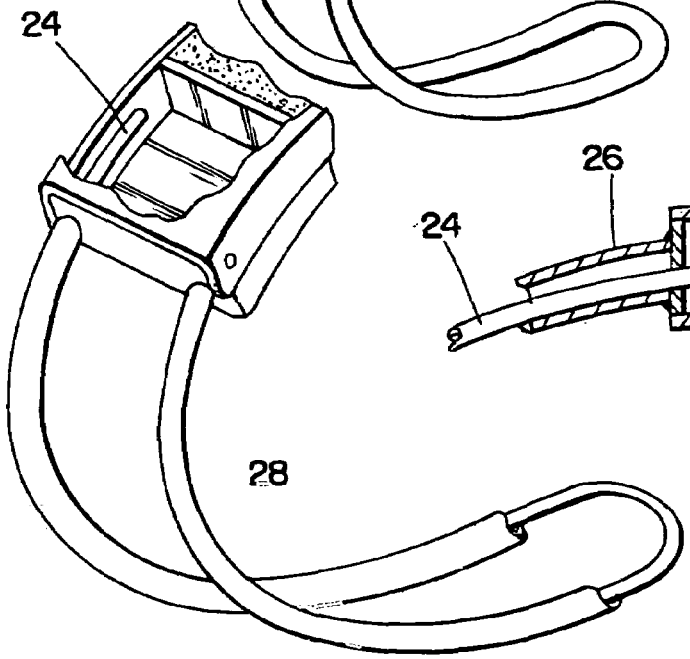
FIG. 5 is a partial cut-away view of the bracelet of FIG. 4 showing how the article of jewelry stores a single catheter.
Figure 6:
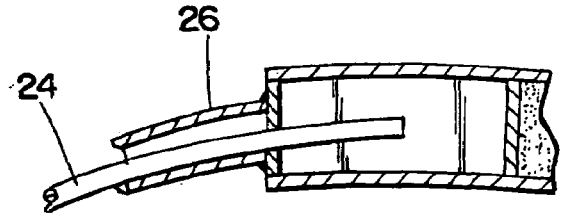
FIG. 6 is cross-section view taken from FIG. 5.
Figure 8:
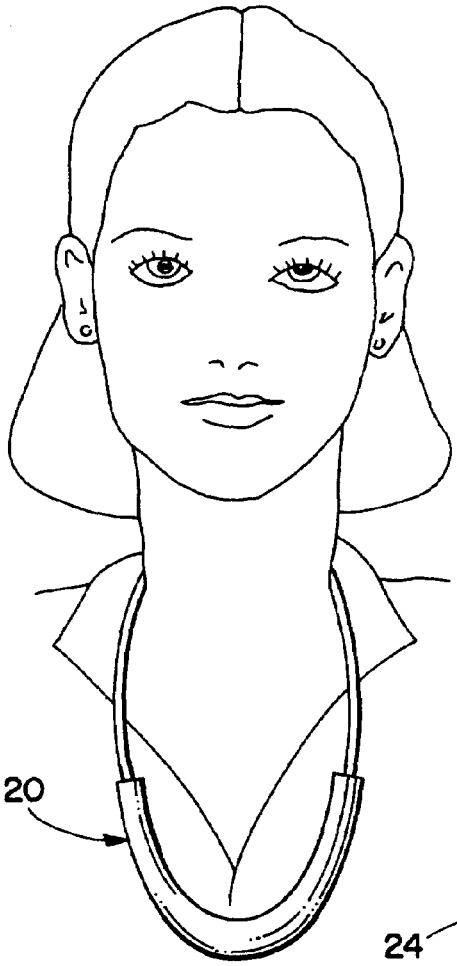
FIG. 8 is a front view of another embodiment of the present invention showing a necklace adapted for storing and concealing a catheter.
Figure 10:
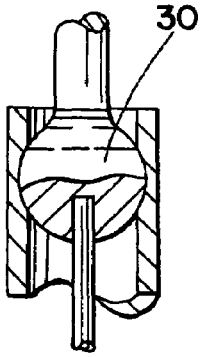
FIG. 10 is a partial cross-section view of the necklace of FIG. 8 showing the opening and fastening device which enables insertion of the catheter into the necklace and later removal.
Figure 11:
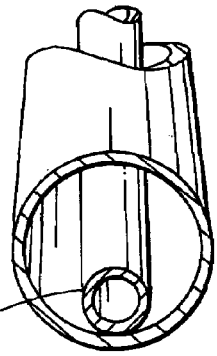
FIG. 11 is a partial cut-away view of the necklace of FIG. 8 showing the inserted catheter.
Figure 9:
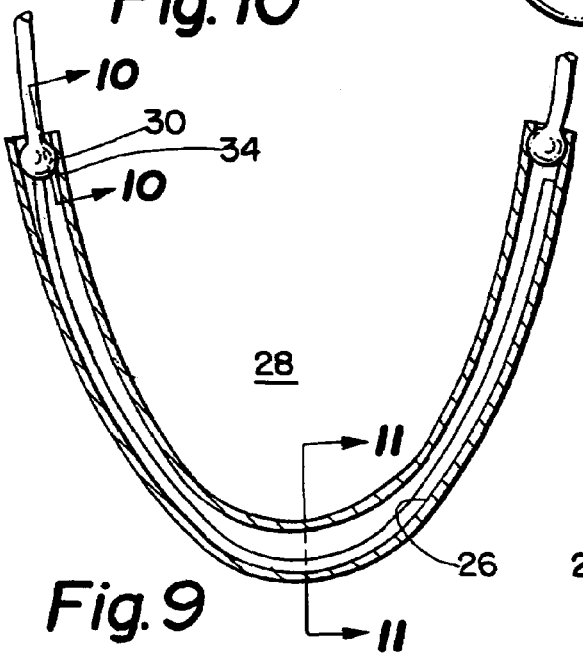
FIG. 9 is a partial cross-section view showing the interior hollow portion of the necklace of FIG. 8.

Now referring to the Figures, the exterior of different pieces of jewelry 20 is shown. The pieces of jewelry 20 come in a variety of forms as previously depicted. In FIG. 1, the article of jewelry 20 holding a catheter 24 is a gemstone bracelet 20. As shown in FIG. 4, the article of jewelry 20 holding a catheter 24 is an ID bracelet 20. Furthermore, the article of jewelry 20 holding a catheter 24 is a necklace 20 as shown in FIG. 8. In FIG. 13, the article of jewelry 20 containing the catheter 24 is a watch 1. Finally, the article of jewelry 20 containing the catheter 24 includes a cloth sleeve 20 as shown in FIG. 15.

Each article of jewelry 20 described in the Figures varies in price range. One factor of price depends on the previously described embodiments the article of jewelry 20 may take. For instance, a gemstone bracelet 20 costs more than a cloth sleeve 20 bracelet. Another factor depends on the material selected to construct the article of jewelry 20. For example, the material used in constructing the article of jewelry 20 varies from a relatively cheap stainless steel or copper to a more expensive material such as silver or gold. Additionally, the article of jewelry 20 may include etchings or items, including diamonds, fastened to the article of jewelry 20. Accordingly, the more technical the etchings and the more items fastened on the article of jewelry 20 the higher the price.

Figure 7:
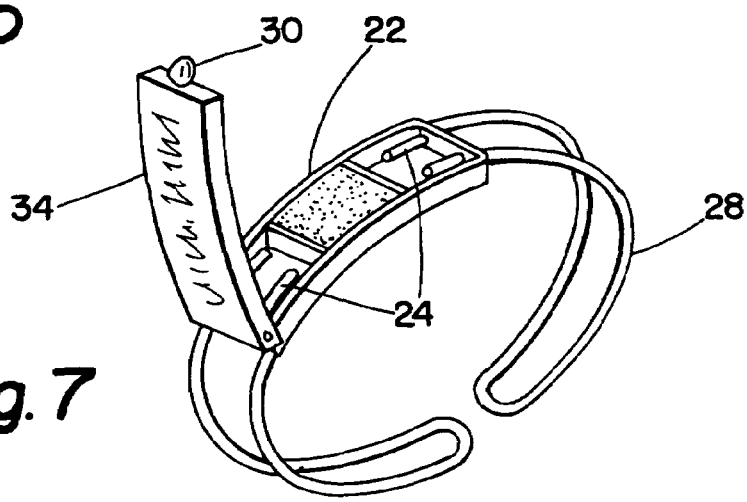
FIG. 7 is a perspective view of the bracelet of FIG. 4 showing the interiorly held catheters and accessory compartment.
Figure 12:
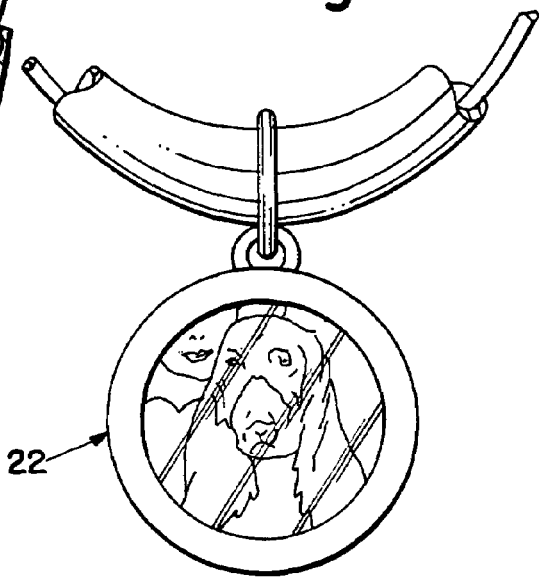
FIG. 12 is a front view of the necklace of FIG. 8 with an ornament fastened to the necklace containing an accessory compartment.

An additional factor which may increase the price of the necklace 20 as shown in FIG. 12 is the ornament 22. Besides the price, however, the ornament also comprises a holder 22 for lubrication. In operation, the lubrication 22 in conjunction with the catheter 24 provides a smooth catheter 24 insertion into the urinary tract. Extending beyond the necklace 20 embodiment, the lubrication holder 22 comes in a variety of forms depending on the article of jewelry 20. For example, the gemstone bracelet 20 stores the lubrication holder 22 within the top portion of the article of jewelry 20 as shown in FIG. 1. In FIG. 7, the ID bracelet 20 stores the lubrication holder 22 along the catheter 24. In FIG. 14, the watch 20 stores the lubrication 22 within the top of the article of jewelry 20. Finally, the cloth sleeve 20 attaches the lubrication 22 through an ornament 22 as shown in FIG. 16. As a result, the article of jewelry 20 stores and conceals the lubrication holder 22 along with the catheter 24.

While the invention has been particularly shown and described with reference to preferred embodiments thereof, it will be understood by those skilled in the art that the foregoing and other changes in form and details may be made therein without departing from the spirit and scope of the invention.

What is claimed is:

1. An arrangement, comprising:

an article of jewelry having an internal compartment formed therein; and a urinary catheter, removably and concealingly stored in the internal compartment.

2. The arrangement of claim 1, further comprising:

an attachment for containing lubrication for the catheter.

3. The arrangement of claim 1, wherein:

the urinary catheter comprises poly(tetrafluoroethylene), flexible plastic, latex, or silicone rubber.

4. The arrangement of claim 1, wherein:

the article of jewelry further comprises an opening device for accessing the internal compartment and means for fastening the opening device.

5. The arrangement of claim 4, wherein the opening device comprises an opening at each of opposite end sections of the article of jewelry.

6. The arrangement of claim 4, wherein the fastening means comprises at least one of a clip, Velcro, or a metal latch.

7. The arrangement of claim 4, wherein:

the article of jewelry comprises a bracelet.

8. The arrangement of claim 4, wherein:

the article of jewelry comprises a necklace.

9. The arrangement of claim 4, wherein:

the article of jewelry comprises a cloth sleeve.

10. The arrangement of claim 4, wherein:

the article of jewelry comprises a watch fob.

11. The arrangement of claim 10, wherein:

the opening device comprises a hinged face of the watch fob.

12. The arrangement of claim 1, wherein:

the internal compartment further comprises an inner material buffer limiting movement of the catheter therein.

13. The arrangement of claim 1, wherein:

the internal compartment has walls formed from a material selected from the group consisting of: gold, copper, silver, and stainless steel.

* * * * *